United States Patent [19]

Goodacre et al.

[11] Patent Number: 4,695,199

[45] Date of Patent: Sep. 22, 1987

[54] ELASTOMERIC BEARING PAD AND SEAL FOR A REMOVABLE BOTTOM FOUNDED STRUCTURE

[75] Inventors: John H. Goodacre, Glen Ellyn, Ill.; Larry J. Hall, Birmingham, Ala.

[73] Assignee: Chevron Research Company, San Francisco, Calif.

[21] Appl. No.: 869,524

[22] Filed: Jun. 2, 1986

[51] Int. Cl.[4] ..... E02B 17/00; E02D 5/74

[52] U.S. Cl. ..... 405/224; 405/195; 405/203

[58] Field of Search ..... 405/203, 204, 195, 208, 405/207; 114/296

[56] References Cited

U.S. PATENT DOCUMENTS

| | | | |
|---|---|---|---|
| 2,530,160 | 11/1950 | Finley . | |
| 2,657,661 | 11/1953 | Robson | 114/201 |
| 2,686,343 | 1/1951 | Harpoothian et al. . | |
| 2,720,011 | 5/1951 | Krupp . | |
| 2,937,006 | 5/1960 | Thayer | 255/2.5 |
| 3,348,517 | 10/1967 | Johnson et al. | 114/296 |
| 3,494,136 | 2/1970 | Wilms . | |
| 3,520,543 | 7/1970 | Etter et al. | 114/296 X |
| 3,701,500 | 10/1972 | Zeffer et al. | 244/103 R |
| 3,892,287 | 7/1975 | Bennett | 114/296 X |
| 3,896,628 | 7/1975 | Hansen . | |
| 3,961,490 | 6/1976 | Corgnet . | |
| 4,155,671 | 5/1979 | Vos | 405/203 |
| 4,425,055 | 1/1984 | Tiedemann | 405/217 |
| 4,521,133 | 6/1985 | Suzuki et al. | 405/195 |
| 4,522,532 | 6/1985 | Fedrick | 405/195 X |
| 4,576,518 | 3/1986 | Cooke et al. | 405/203 X |

FOREIGN PATENT DOCUMENTS 2247377 6/1975 France .

OTHER PUBLICATIONS

A. Della Greca, "New Concept of Offshore Drilling/-Production Arctic Platform and Dynamic Analysis . . ." 2/12-17/84 ASME, 1984.

Buslov et al., "Detachable Systems-Alternative Approach for Arctic Exploratory Structures", pp. 519-529.

Stenning et al., "Arctic Offshore Deepwater Ice Structure Interactions" OTC 3630, pp. 2356-2365.

G. Sebastiani et al., "Offshore Drilling and Production Platforms with Rapid Removal and Redeployment . . ." pp. 631-642.

*Primary Examiner*—Dennis L. Taylor

*Attorney, Agent, or Firm*—E. J. Keeling; P. L. McGarrigle; V. A. Norviel

[57] ABSTRACT

The Removable Bottom Founded Structure (RBFS) is an offshore platform for petroleum drilling and producing operations intended for deployment in waters with severe weather and iceberg conditions. The structure is normally held down by gravity, but during the deballasting procedure a hold-down system is employed to keep the platform on the subbase until site evacuation. The system that is used to hold the platform down onto the subbase is located where the platform meets the subbase. It operates on the principle of hydrostatics. On the top surface of the subbase there are circularly arranged elastomeric bearing pads that define chambers which may be evacuated by pumping and which are vented to the outside atmosphere. Pressure by the platform on the bearing pads creates a fluid-tight seal so that no seawater will enter the evacuated chambers. The seawater evacuation causes a reduction of the buoyancy forces on the underside of the platform which will hold the platform onto the subbase until such time as the platform is totally deballasted. Once that has occurred, the hydrostatic hold-down system is disengaged and the platform will quickly rise to the surface.

2 Claims, 7 Drawing Figures

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

ELASTOMERIC BEARING PAD AND SEAL FOR A REMOVABLE BOTTOM FOUNDED STRUCTURE

CROSS REFERENCE TO RELATED APPLICATIONS

This application is related to applications having the U.S. Ser. Nos. 839,492; 869,525; 866,825; 835,420; 835,419; and 898,989, all assigned to the assignee of this application.

FIELD OF THE INVENTION

This invention generally relates to offshore oil drilling and producing structures. More specifically, to a sealing/hold-down system that is used on a structure for removably detaching that structure from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these conditions, many different types of platform designs have arisen in an attempt to cope with the harsh weather and other natural elements.

Currently, much exploration is conducted in the arctic and the ice-infested waters off Alaska, Canada, and Greenland. To cope with the iceberg and weather problem, some structures to resist these large ice masses by simply being large enough to withstand the crushing forces. Examples of these designs may be seen in dual cone structures, such as U.S. Pat. No. 4,245,929, large reef-like structures, or many other gravity based large concrete-steel configurations, see also U.S. Pat. No. 4,504,172. However, these structures are either too heavy, expensive, or are permanently affixed to the bottom. As such, they do not lend themselves to either reuse or quick site evacuation in the case of an emergency situation.

Another design is a tension-leg platform (TLP) with disengageable or extensible legs as described in U.S. Pat. Nos. 3,955,521 and 4,423,985. These too have their inadequacies. The TLP maintains a stable floating position by its own buoyancy and the tendons that connect the structure to the sea floor. The allowable deck load for the TLP is limited due to its available buoyancy. Furthermore, there may be problems with icebergs that have drafts large enough to scour the sea floor. Most TLP structures have exposed wellheads and anchoring sytems and thus would incur substantial damage if an iceberg of this size came along. Additionally, since the platform is naturally buoyant, the tendons are under constant tension which generally shortens the life of the tie down system.

Another factor to be considered is cost. Generally, the type of large gravity based structure that may be used for arctic exploration and production is very expensive and time consuming to build. With the unproven nature of some of the oil prospects, the harshness of the environment, the increased costs due to the weather down time, the probability of failure, and even the political climate, it becomes even more risky for an oil company to invest a large amount of money or time. In the event of an accident or other type of misadventure, losses could be greatly multiplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy or ballast and a subbase upon which the platform may rest. This structure may then be floated to a drilling or production site and slowly filled with ballast until both the platform and the subbase rest on the sea floor. When a situation, threatening to the structure, presents itself, the platform may be deballasted and removed from the site to leave the subbase behind. However, this deballasting procedure is quite slow (on the order of 6 to 7 hours) and since it is probably going to be done in rough seas, there is a large chance that the structure may be damaged when it "bounces around" as it approaches neutral buoyancy, but before it reaches its floating draft.

A solution to this problem is to keep the platform down on the subbase 3 with a hold-down means while it is being deballasted. Once it has fully deballasted, the hold-down means may then be released to allow the platform 1 to quickly ascend to its floating draft and escape damage.

This hold-down system may be mechanical or hydraulic. However, because a mechanical system: may not assure a simultaneous release of all mechanical systems; is expensive; and difficult to reuse, a hydrostatic sealing system is chosen. This hydrostatic system will hold the structure to the base from the beginning of the deballasting procedure to the time when deballasting is complete. When this occurs, the structure must be quickly detached by releasing the seal and then floated away from the impending danger.

To eliminate most of the problems of these previously-mentioned arctic structures for use in ice-infested waters, the Removable Bottom Founded Structure (RBFS) was developed to provide a platform which may be removably detached from its base with the help of the aforementioned seals and, if necessary, transported to a safer location.

SUMMARY OF THE INVENTION

The present invention holds a buoyant platform onto a subbase that rests on the sea floor. The platform is called a Removable Bottom Founded Structure (RBFS) and it is designed for the arctic environment. The RBFS resembles a very large submersible drilling platform which, by virtue of its direct access to the wells, functions in many ways like a conventional fixed drillng and production platform. Normally the platform would be fully ballasted on the subbase with a combination of water and solid ballast. However, in the event of an approaching iceberg (larger than one which the RBFS is designed to resist), the sealing system is engaged, the platform is deballasted to a positive buoyancy condition, the risers are disconnected from the subbase, then the sealing system is released, and the platform floats, and propels itself off location to leave the subbase behind. In this design environment, the platform must disconnect from the subbase and reach its floating draft very quickly to avoid potential collision between the platform and subbase. Here, the hold-down system keeps the platform down on the subbase, the platform is deballasted to achieve a large net buoyant upward force, and then the hold-down mechanism is quickly released to lift off the platform.

To provide an appropriate lift-off mechanism, an elastomeric seal is installed on the underside of the platform. Once the platform rests on the subbase and compresses the elastomeric seal, the area defined by: the seal, the platform, and the subbase, is evacuated to reduce the hydrostatic head and to keep the platform on location. The platform stays in place during this time by effectively removing the buoyancy forces from the underside of the columns; thus the platform alone holds itself down as if it were not resting on water. The platform may be removed once the differential pressure between the area defined by the seal and the outside environment is destroyed.

DETAILED DESCRIPTION OF THE INVENTION

The Removable Bottom Founded Structure (RBFS) is an offshore structure for petroleum drilling and producing operations and is intended for deployment in waters with severe weather and iceberg conditions. The RBFS is a two-part structure. The first part generally comprises a platform and is made up of multiple columns which are affixed to a deck structure. The second component is a reinforced concrete subbase that rests on the sea floor and upon which platform is founded.

The RBFS is designed to withstand severe conditions of wind, wave and current action, and many of those ice conditions which could normally be expected during the structure's life. For example, the RBFS was designed to withstand a 150-year return period storm; an iceberg with a 20-year return period kinetic energy; and to survive (with some damage) on impact with an iceberg having a 100-year return period kinetic energy. However, if an iceberg large enough to cause damage to the RBFS threatens to come in contact with the structure, the platform is evacuated from the site, to leave the subbase behind. To ensure that the inhabitants and operators of the RBFS are apprized of all iceberg and storm dangers, they maintain visual lookouts for good days and shorter distances whereas they use a radar system for longer distances and less clear weather. Danger zones, having specified radii, may also be established to allow the platform personnel to gauge the possibility of actual iceberg incursion.

Figure 1:
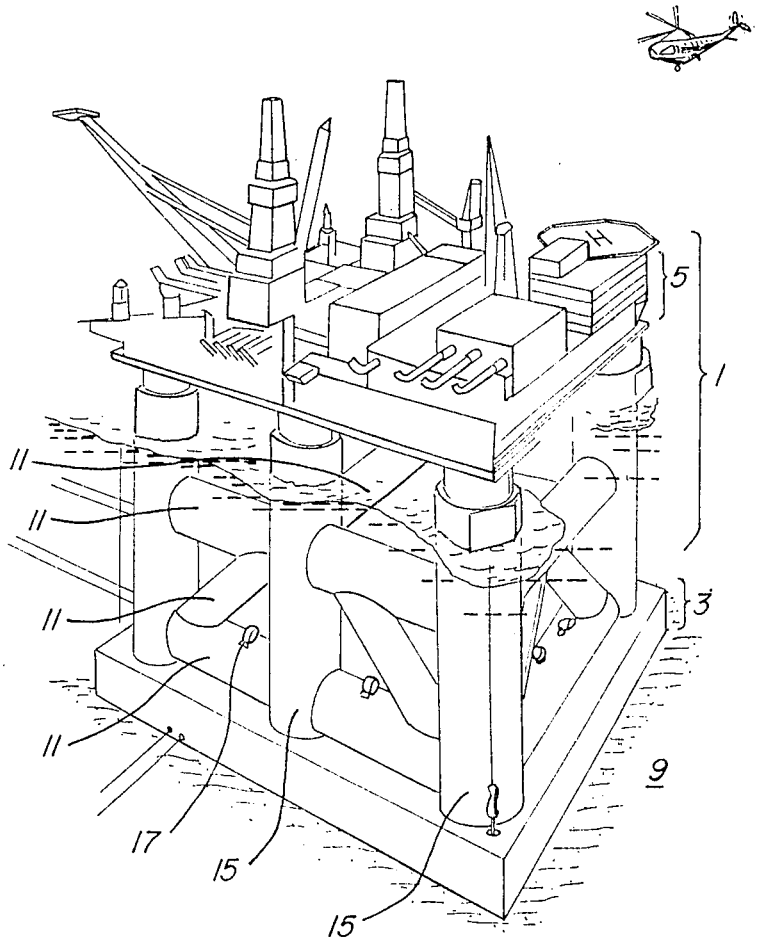
FIG. 1 is a view of the assembled platform resting on the subbase.

FIG. 1 shows that the RBFS comprises two portions, a platform 1 and a subbase 3. The platform 1 is comprised of a deck 5, columns 15, and braces 11. The subbase 3 is affixed to the sea floor 9 and provides a surface to receive axial and lateral loads from the platform 1.

The subbase 3 is a permanent reinforced concrete structure, the configuration of which is generally shown in FIG. 1. It is designed to withstand a 100-year iceberg impact with practically no movement and no structural damage and is able to survive a 2000-year iceberg (while it protects a subsea drilling template) with limited damage. The subbase 3 provides a bearing surface for vertical and lateral load transfer from the platform 1 and protects the well template from iceberg scour.

To prevent potential collision between the platform 1 and the subbase 3 during an iceberg avoidance operation, the platform 1 must rise quickly to its floating draft, otherwise the platform 1 may come in contact with the subbase 3. Furthermore, to shorten the overall iceberg avoidance procedure, the platform 1 must be deballasted concurrently with other iceberg avoidance operations such as shutting in wells and purging and disconnecting the risers. To hold the platform 1 onto the subbase 3 while deballasting (and becoming more buoyant) the hydrostatic pressure that acts on the platform 1 must be reduced. To accomplish this, a seal 30 encloses a space 31 underneath a column 15. After this space 31 between the subbase 3, the column 15 and the seal 30 is shut off from the outside seawater, the hold-down system is activated. Evacuating the water out of the space 31 reduces the hydrostatic pressure acting on the bottom of the column 15 and will effectively hold the platform 1 on the subbase 3.

Figure 5:
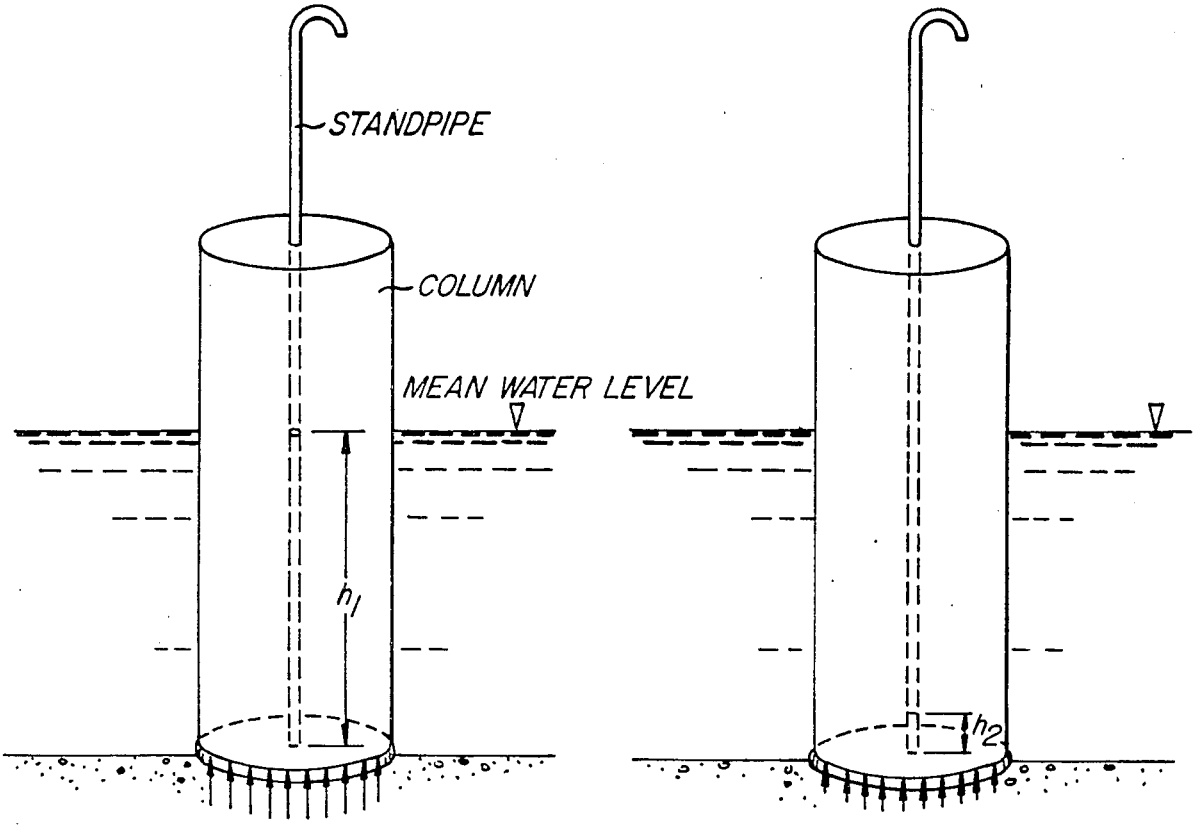
FIG. 5 represents the forces that act on the underside of a buoyant column.

The hydrostatic hold-down system reduces the hydrostatic head on the area underneath the column 15. FIG. 5 represents the buoyancy forces acting on a column before and after the sealing system is engaged. In normal states, the buoyant force that acts on a column may be shown by $P_1=\delta \cdot h_1 \cdot A$ where $P_1$ is the total buoyant force, $\delta$ is the density of water, $h_1$ is the height of water in the standpipe, and A is the area underneath the column. However, operation of the hold-down system reduces the water level in the standpipe to $h_2$. This decreases the buoyant force to a new value which can be expressed as $P_2=\delta \cdot h_2 \cdot A$. The difference in hydrostatic pressure between the outside environment and the area underneath the column is maintained by the seals around the perimeter of the column which keeps the platform 1 on location.

Figure 2:
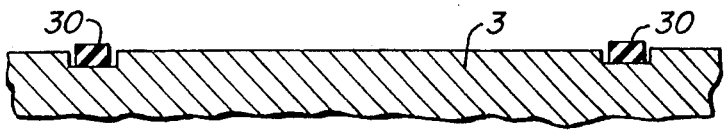
FIG. 2 is a cross-sectional view of the subbase with the sealing system.
Figure 2A:
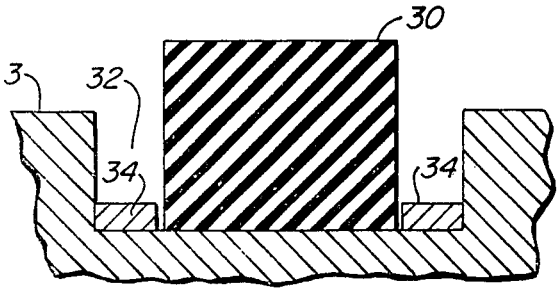
FIG. 2*a* is an enlarged cross-sectional view of the elastomeric seal.
Figure 3:
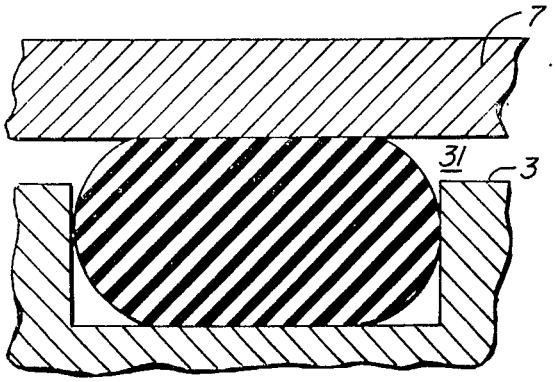
FIG. 3 is a cross-sectional view of the elastomeric seal as it is compressed by the platform.
Figure 4:
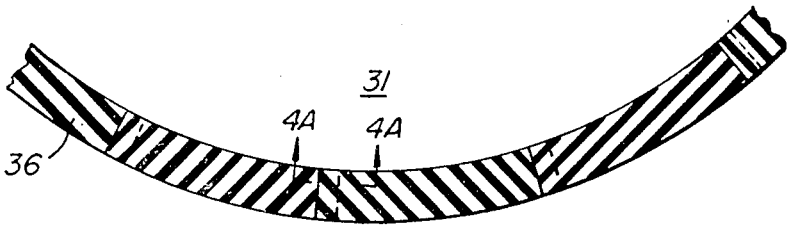
FIG. 4 is a partial plan view of the elastomeric seal segments.
Figure 4A:
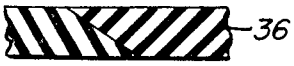
FIG. 4*a* is a side view of the elastomeric seal segments.

FIGS. 2–4 show the seal 30 for the hold-down system. A circularly arranged seal 30, underneath the column 15, encloses a hold-down chamber 31 between the column 15 and the subbase 3. During normal platform operation, when the RBFS behaves as a gravity structure and a hold-down force is not needed, the chamber 31 is open to the ambient hydrostatic pressure. As the platform 1 is deballasted and becomes more buoyant, the hydrostatic pressure in the chamber 31 is reduced to create a hold-down force. The hold-down force equals the product of the plan area of the chamber 31 and the differential pressure in the chamber 31 which is $\Delta P=\delta(h_1-h_2)$ (the differential pressure is the ambient hydrostatic pressure at the top of the subbase 3 less the pressure in the chamber 31 which corresponds to the water level in the chamber 31). The sum of the hold-down forces in each space 31 would be sufficient to prevent platform 1 lift-off under the combined effects of the buoyancy of the deballasted platform 1 and the design storm loads. The hold-down force is deactivated by opening the space 31 to the ambient hydrostatic pressure.

FIGS. *2a* and 3 show that the seal 30 for the hold-down system consists of an elastomeric bearing pad mounted in a channel 32 in the subbase 3. The thickness of the bearing pad 30 is a function of the load it must carry (i.e., the platform weight). The channel depth ensures a gap between the underside of the column 15 and the top of the subbase 3 and is wide enough to allow for clearance when the bearing pad 30 bulges when it compresses as the platform 1 is set down (see FIG. 3). The elastomer that is used for the bearing pad 30 is chosen for strength, compressibility, resilience, and resistance to deterioration in seawater over time.

As shown in FIG. 4 the bearing pad 30 is installed in the subbase 3 in 16 segments 36 that complete a circle. The radius of this circle is approximately 8.5 m, each segment covers an arc of approximately 22.5°. They are mitered (see FIG. *4a*) to produce a lapped joint so that they fit together with neighboring segments, however, the first and last segments are mitered differently from the remaining ones so that the last segment fits into place in a keystone fashion.

The bearing pad 30 has a specific gravity exceeding that of seawater. This is to ensure that the pad 30 remains in place under its own weight when the platform 1 is not in place. Space bars 34 keep the segments 36 centered in the channel 32. This eliminates any structural connection between the pad 30 and the subbase 3 which simplifies replacement of the pad 30 should that become necessary.

The elastomeric bearing pad 30 seals in the following manner. As the platform 1 is ballasted down onto the subbase 3, the bearing pad 30 in the channel 32 of the subbase 3 makes contact with the underside of the column 15. A space 31 is sealed off between the platform 1 and the subbase 3, and is perimetered by the seal 30. The water in this space 31 can then be evacuated by some type of pump means prior to platform evacuation. Once this space 31 has been partially or substantially evacuated, the difference, in the hydrostatic head between the space 31 underneath the platform 1 and the outside environment, keeps the platform 1 on location.

The platform 1 lifts off the subbase 3 when the difference in the hydrostatic pressure between the space 31 and the outside seawater is destroyed. To equilibrate the pressure in the space 31 (to that of the seawater) additional pressure may be used from such things as pumps, etc., but an easier way to destroy the pressure differential is to allow seawater at that depth to flow into the space 31 from the outside. Once that is done the pressure on both sides of the seal 30 equalizes and the natural buoyancy of the platform 1 causes it to rise.

The hydrostatic hold-down system is not necessary for the RBFS during normal operating conditions (because it is normally held in place by gravity), however, the seals 30 would be frequently tested for leaks. Prior to leaving the site, the area defined by the seals is evacuated and the platform 1 is deballasted by pumping out the ballast chambers. The pumps are sized to deballast the platform 1 in five hours. Redundant control of ballast tanks from several independent pumps is designed into the system, and ballast control is fully automated with manual backup.

If the seals 30 are effective, then essentially all the water in the space 31 is removed. A float valve (not shown) turns off an evacuation pump when the water is gone and reactivates the evacuation pump in the event of water leakage into the space 31. While the platform 1 is being fully deballasted and the area defined by the seals has been evacuated, the various mechanical systems are prepared for liftoff.

Since the RBFS evacuates the site on impending impact of a large iceberg, all piping and control lines between the platform 1 and subbase 3 are readily disconnectable. (None of the following material is illustrated.) Therefore, the next step before site evacuation is to hydraulically disengage the riser mechanical latching system to lift the entire integrated riser bundle into the column 15 by means of hydraulic hoists. The production and injection wells and oil sales lines are shut in subsea and all lines in the intergrated riser are purged with seawater. This is the final preparatory step in the liftoff procedure.

Immediately after the platform 1 lifts off the subbase 3, the platform 1 moves away under positive navigational control achieved with a thruster system built into the platform 1 (see FIG. 1). Thrusters 17 may be positioned at locations on the platform 1. The thruster system steers the platform 1 in a controlled manner, but does not keep the platform on location in severe storm states. Tugs in the vicinity (for iceberg towing, surveillance and other purposes) provide further steering control once sea conditions permit attachment of towing lines.

When sea and ice conditions again permit, the platform 1 is rested on the subbase 3 and the platform 1 is reballasted. The integrated riser bundle (this system is not shown) is stabbed into its receptacle in the subbase 3, hydraulic hoists are used to stab a riser connector down onto a connecter mandrel, and an integrated riser is reconnected to the wellhead. Drilling risers (also not shown) are also reattached to the well template through a moon-pool and the normal operations resume.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. A sealing apparatus to hold a gravity founded, movable offshore structure onto a subbase during deballasting of that structure, comprising:

a movable offshore platform;

means for ballasting and deballasting said platform;

a plurality of load bearing columns fixedly connected to said platform in a generally downward direction;

a pontoon fixedly connected to the lower surface of said columns;

a generally flat lower surface on the underside of said pontoon;

a subbase located on the sea floor to support the pontoon;

a generally flat upper surface of said subbase;

a circular channel in the subbase arranged in a closed loop;

an elastomeric bearing pad, having a specific gravity greater than seawater, placed in the circular channel, the elastomeric bearing pad extending out of the channel so that when the pontoon compresses the elastomeric bearing pad, a fluid-tight space is created between the subbase, the pontoon and the elastomeric bearing pad;

space bars to hold the elastomeric bearing pad substantially in the center of the channel; and means to evacuate the water from the space.

2. Apparatus as recited in claim 1 wherein said elastomeric bearing pad further comprises overlapping arcuate sections.

* * * * *